US007347172B2

(12) United States Patent
Strickler et al.

(10) Patent No.: US 7,347,172 B2
(45) Date of Patent: Mar. 25, 2008

(54) HYDRAULIC VALVE ACTUATION SYSTEM WITH VALVE LASH ADJUSTMENT

(75) Inventors: Scott L. Strickler, Fishers, IN (US); Will W. Mathews, Greenfield, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 458 days.

(21) Appl. No.: 11/126,776

(22) Filed: May 10, 2005

(65) Prior Publication Data

US 2006/0254542 A1 Nov. 16, 2006

(51) Int. Cl.
*F01L 9/02* (2006.01)

(52) U.S. Cl. ..... 123/90.12; 123/90.13; 91/392

(58) Field of Classification Search ..... 123/90.12, 123/90.13; 91/392, 410; 137/511, 625
See application file for complete search history.

(56) References Cited

U.S. PATENT DOCUMENTS

| | | | | |
|---|---|---|---|---|
| 2,019,970 | A | 11/1935 | Hopkins | |
| 3,179,094 | A * | 4/1965 | Ribeton | 123/90.36 |
| 3,661,127 | A | 5/1972 | Cornell | |
| 4,169,449 | A | 10/1979 | Brock, Jr. | |
| 4,200,067 | A | 4/1980 | Trenne | |
| 4,212,323 | A | 7/1980 | Qureshi | |
| 4,258,672 | A | 3/1981 | Hietikko | |
| 4,502,425 | A | 3/1985 | Wride | |
| 4,572,114 | A | 2/1986 | Sickler | |
| 4,656,976 | A | 4/1987 | Rhoads | |
| 4,664,070 | A | 5/1987 | Meistrick et al. | |
| 4,892,067 | A | 1/1990 | Paul et al. | |
| 4,901,684 | A | 2/1990 | Wride | |
| 5,002,022 | A | 3/1991 | Perr | |
| 5,012,778 | A | 5/1991 | Pitzi | |
| 5,117,213 | A | 5/1992 | Kreuter et al. | |
| 5,129,373 | A | 7/1992 | Cuatt et al. | |
| 5,191,867 | A | 3/1993 | Glassey | |
| 5,224,683 | A | 7/1993 | Richeson | |
| 5,248,123 | A | 9/1993 | Richeson et al. | |
| 5,287,829 | A | 2/1994 | Rose | |
| 5,339,777 | A | 8/1994 | Cannon | |
| 5,379,737 | A | 1/1995 | Hu | |
| 5,392,749 | A | 2/1995 | Stockner et al. | |
| 5,410,994 | A | 5/1995 | Schechter | |
| 5,419,301 | A | 5/1995 | Schechter | |
| 5,421,359 | A | 6/1995 | Meister et al. | |

(Continued)

FOREIGN PATENT DOCUMENTS

KR 2004107689 A * 12/2004

*Primary Examiner*—Ching Chang
(74) *Attorney, Agent, or Firm*—Jeffrey P. Calfa; Gerald W. Askew

(57) ABSTRACT

A hydraulic valve actuation system has a hydraulic actuator connected with a valve in an engine. The hydraulic actuator has a boost pin enclosing a drive pin in a casing. The drive pin connects with and defines a valve lash with a valve stem of the valve. The hydraulic actuator applies and releases an actuating force through the drive pin to the valve stem that selectively opens and closes the valve during engine operation. The hydraulic actuator adjusts the valve lash during one or more rest periods. By adjusting the valve lash during the rest periods, the hydraulic actuator essentially adjusts the valve lash in response to one or more of the actual physical parameters of the valve during engine operation.

9 Claims, 6 Drawing Sheets

U.S. PATENT DOCUMENTS 5,448,973 A 9/1995 Meyer
5,456,221 A 10/1995 Schechter
5,456,222 A 10/1995 Schechter
5,456,223 A 10/1995 Miller et al.
5,462,025 A 10/1995 Israel et al.
5,529,030 A 6/1996 Rose
5,531,192 A 7/1996 Feucht et al.
5,566,652 A 10/1996 Deppe
5,595,148 A 1/1997 Letsche et al.
5,636,602 A 6/1997 Meister
5,638,781 A 6/1997 Sturman
5,645,031 A 7/1997 Meneely
5,787,858 A 8/1998 Meneely
5,829,397 A 11/1998 Vorih et al.
5,967,105 A 10/1999 Freeland
5,970,956 A 10/1999 Sturman
6,044,815 A 4/2000 de Ojeda
6,116,570 A 9/2000 Bulgatz et al.
6,263,842 B1 7/2001 De Ojeda et al.
6,338,320 B1 1/2002 De Ojeda
6,763,790 B2 7/2004 Watson et al.
6,786,186 B2 9/2004 de Ojeda
6,988,471 B2 * 1/2006 Chang ..... 123/90.12
2002/0121251 A1 9/2002 Watson et al.
2003/0015155 A1 1/2003 Turner et al.

* cited by examiner

HYDRAULIC VALVE ACTUATION SYSTEM WITH VALVE LASH ADJUSTMENT

BACKGROUND OF THE INVENTION

1. Field of the Invention

This invention relates to valve actuation systems in internal combustion engines. More specifically, this invention relates to hydraulic actuation systems for intake and exhaust valves in diesel engines.

2. Description of Background Art

Most internal combustion engines have actuated valves that selectively open and close to provide combustion air and remove exhaust gases from each cylinder. Internal combustion engines usually convert chemical energy from a petroleum-based fuel such as gasoline or diesel into mechanical energy. Diesel engines usually compress air in the cylinder and then inject fuel into the cylinder for the compressed air to ignite. The ignited fuel generates rapidly expanding gases that actuate a piston. Each piston usually is connected to a crankshaft or similar device for converting the reciprocating motion of the piston into rotational motion. The rotational motion from the crankshaft may be used to propel a vehicle, operate a pump or an electrical generator, or perform other work. The vehicle may be a truck, an automobile, a boat, or the like.

Many diesel engines have intake and exhaust valves near a fuel injector on the top of each cylinder. Each intake and exhaust valve usually has a valve element disposed in a passageway formed by a cylinder head. The passageway connects to the cylinder through an opening in a valve seat formed by the cylinder head. In intake valves, intake air flows through the passageway into the cylinder. In exhaust valves, exhaust gases flow out of the cylinder into the passageway. The valve element usually has a stem connected to a head. A spring typically is disposed on the stem. The spring biases the head into a closed position against the valve seat.

Diesel engines usually have an actuating mechanism connected to the stem of each valve. The actuating mechanism selectively presses against the stem, overcomes the biasing force of the spring, and thus moves the head into an open position away from the valve seat. The actuating mechanism may be a push rod, a rocker arm, a cam on a camshaft, a hydraulically actuated drive pin, a combination thereof, or the like.

The gap or clearance between the stem and the actuating mechanism defines a valve lash. The valve lash may adversely affect engine performance if the valve lash is too small or too large. If the valve lash is too small at lower temperatures, the valve may not close fully and or may open unintentionally during engine operation at higher temperatures. If the valve lash is too large, the valve may have a delay in opening and may not open sufficiently during engine operation.

In most engines, the valve lash is adjusted mechanically or hydraulically. The valve lash may be adjusted mechanically when the engine is cold using a lash adjustment screw or like device with gauges and probes to determine the valve lash position. The valve lash may be adjusted hydraulically by a hydraulic lash adjuster that uses engine oil to change the valve lash during engine operation. The valve lash adjustments typically are made to compensate for estimated variations in one or more physical parameters such as thermal expansion, valve seat wear, manufacturing tolerances, and the like. The valve lash adjustments may include allowances when the estimated variations are not known or can vary.

However, the estimated variations and allowances may not be the same as the actual physical parameters for a particular valve. The actual wear on a valve seat may be more or less than the estimated wear. The actual manufacturing tolerances may be more or less than the estimated manufacturing tolerances. The difference between the actual physical parameters and the estimated variations and allowances may provide a valve lash that adversely affects engine performance.

SUMMARY

This invention provides a hydraulic valve actuation system that has a hydraulic actuator to selectively open and close a valve during engine operation. The hydraulic actuator adjusts the valve lash between the hydraulic actuator and the valve during one or more rest periods of the hydraulic actuator. By adjusting the valve lash during the rest periods, the hydraulic actuator essentially adjusts the valve lash in response to one or more of the actual physical parameters of the valve during engine operation rather than an estimate of and/or allowance for the physical parameters.

A hydraulic valve actuation system in an engine may have a hydraulic actuator connected with a valve. The hydraulic actuator and the valve define a valve lash. The hydraulic actuator is operable to selectively open and close the valve. The hydraulic actuator is operable to adjust the valve lash during one or more rest periods.

A hydraulic actuator for a valve in an engine may have a casing, a boost pin, a drive pin, and a cap. The casing forms an actuation chamber with an actuation opening and a cap opening. The boost pin is disposed in the actuation chamber. The boost pin is operable to move within the actuation chamber. The boost pin forms a lash chamber with a drive opening and a boost opening. The drive pin is disposed in the lash chamber. The drive pin is operable to move in the lash chamber and to extend through the drive and actuation openings. The cap is disposed in the cap opening. The drive pin and boost pin are operable to actuate a valve. The drive pin and boost pin are operable to adjust a valve lash when oil enters the lash chamber during one or more rest periods.

In a method of actuating a valve in an engine, the valve lash between a hydraulic actuator and a valve is hydraulically adjusted during one or more rest periods of the hydraulic actuator. The hydraulic actuator applies an actuating force to the valve. The hydraulic actuator releases the actuating force from the valve. The valve applies a biasing force to the hydraulic actuator.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE PREFERRED EMBODIMENTS

Figure 1:
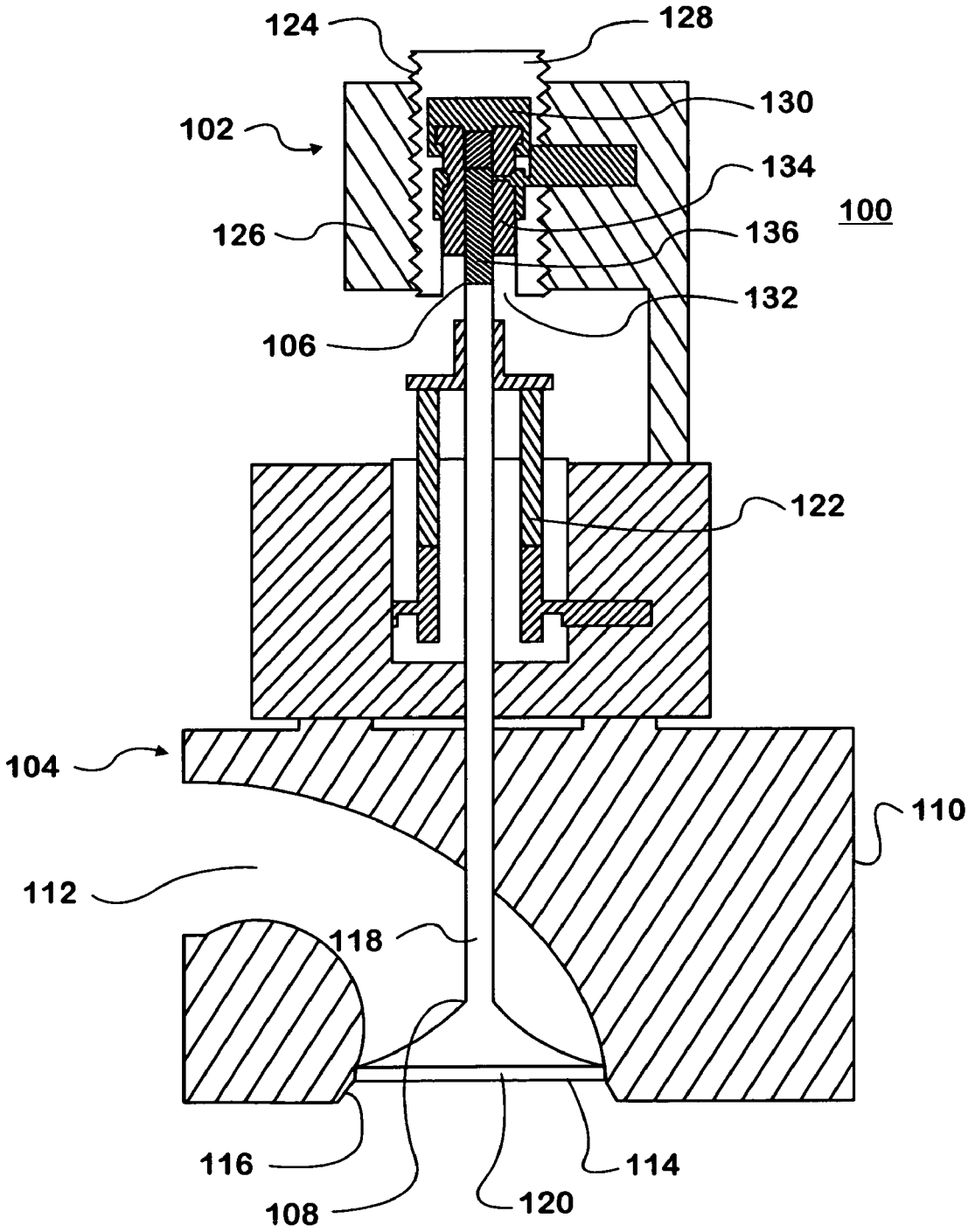
FIG. 1 is a cross-section view of a hydraulic valve actuation system in an engine.

FIG. 1 is a cross-section view of a hydraulic valve actuation system 100 in an engine. The hydraulic valve actuation system 100 includes a hydraulic actuator 102 connected with a valve 104. The hydraulic actuator 102 selectively opens and closes the valve 104 during engine operation. The hydraulic actuator 102 and the valve 104 define a valve lash 106, which is the gap or clearance between the hydraulic actuator 102 and the valve 104. The hydraulic actuator 102 hydraulically adjusts the valve lash 106 during rest periods when the hydraulic actuator 102 is not opening or closing the valve 104. The valve lash adjustment is responsive to one or more of the actual physical parameters of the valve 104 during engine operation. While a particular configuration is shown, the hydraulic valve actuation system 100 may have other configurations including those with additional components.

The valve 104 includes a valve element 108 disposed in a cylinder head 110 of the engine. The valve 104 may be an intake valve, an exhaust valve, or the like. The cylinder head 110 forms a passageway 112 that extends to a cylinder through a valve opening 114 defined by a valve seat 116. The valve element 108 includes a valve stem 118 connected to a valve head 120. A biasing device 122 is disposed on the valve stem 118. The biasing device 122 applies a biasing force to hold the valve head 120 against the valve seat 116—a closed position. The biasing device 122 may be a hydraulic spring, a mechanical spring, or the like.

The hydraulic actuator 102 may include a casing 124 disposed in a housing 126 that is mounted on the cylinder head 110. The casing 124 has a cap 128 on one end and forms an actuation chamber 130 with an actuator opening 132 on the other end. A boost pin 134 is disposed in the actuation chamber 130 and encloses a drive pin 136. The drive pin 136 connects with the valve stem 118. The drive pin 136 and valve stem 118 define the valve lash 106.

To open the valve 104, high pressure oil is supplied to the hydraulic actuator 102. The oil may be engine oil, another hydraulic fluid, or the like. High pressure includes pressures that are sufficient to open the valve 104. The high pressure oil enters the actuation chamber 130 and moves the boost pin 134 toward the actuator opening 132. The high pressure oil also moves the drive pin 136 against the valve stem 118. The drive pin 136 applies an actuating force to the valve stem 118. The actuating force of the drive pin 136 overcomes the biasing force of the biasing device 122, and thus moves the valve head 120 away from the valve seat 116. The biasing device 122 may reduce the biasing force in response to the oil pressure in the actuation chamber 130.

The hydraulic actuator 102 opens the valve 104 in two steps—a boost phase followed by a drive phase. The boost and drive phases may be individually controlled and may occur sequentially, concurrently, or a combination thereof. During the boost phase, the hydraulic actuator 102 lifts the valve head 120 away from the valve seat 116 to a boost height. During the drive phase, the hydraulic actuator 102 lifts the valve head 120 farther away from the valve seat 116 to a full drive height—an open position. The full drive height may be determined by a limiting device such as a hard stop, an actuating pressure vent, or the like that may be incorporated in either the biasing device 122 or the hydraulic actuator 102.

The actuation chamber 130 may have a boost chamber connected to a drive chamber having a smaller diameter or cross-section area. The boost pin 134 may be disposed in the drive chamber with a flange section disposed in the boost chamber. The drive pin 136 may be disposed in a lash chamber formed by the boost pin. In the boost phase, high pressure oil enters the boost chamber and moves the boost pin 134 toward the actuator opening 132. When oil is in the lash chamber, the movement of the boost pin 134 causes the drive pin 136 to lift the valve head 120 to the boost height. In the drive phase, high pressure oil enters the lash chamber and moves the drive pin 136 against the valve stem 118. The movement of the drive pin 136 lifts the valve head to the full drive height.

The drive pin 136 may provide a larger actuating force against the valve stem 118 during the boost phase than during the drive phase. Since the boost pin 134 has a larger diameter or cross-section area than the drive pin 136, the actuating force from the high pressure oil on the boost pin 134 would be larger than the actuating force from the same high pressure oil on the drive pin 136. The cross-section area of the flange section may be selected to provide a desired actuating force to the valve stem during the boost phase.

To close the valve, the hydraulic actuator 102 vents oil from the actuation chamber 130 to release the actuating force against the valve stem 118. The valve stem 118 applies the biasing force of the biasing device 122 to the drive pin 136. The biasing force moves the drive pin 136 and then the boost pin 134 towards the cap 128. The drive pin 136 and the boost pin 134 push the oil out of the actuation chamber 130. Drive pin and/or oil inertia may cause the drive pin 136 to move away from the valve stem 118

To adjust the valve lash 106, oil is supplied to the hydraulic actuator 102 during a rest period. The oil may be the high pressure oil used to actuate the valve 104, which is vented before the hydraulic actuator 102 can open the valve 104. The oil may be low pressure oil such as the engine lubrication oil or the like. Low pressure includes pressures that are insufficient to open the valve 104. The hydraulic actuator may have a check valve or other flow control mechanism that is operable to keep the high pressure oil separate from the low pressure oil. The hydraulic actuator 102 hydraulically adjusts the valve lash 106 when the oil enters the actuation chamber 130. The oil moves the boost pin 134 adjacent to the cap 128 and moves the drive pin 136 adjacent to the valve stem 118, thus adjusting the valve lash 106. "Adjacent" includes near, close-by, and in contact. The valve lash 106 may be adjusted to essentially zero or another selected clearance.

The hydraulic actuator 102 adjusts the valve lash 106 during rest periods when the hydraulic actuator 102 is not opening or closing the valve 104. The rest periods include time periods during engine operation from about the time the valve 104 is essentially closed to about the time the hydraulic actuator starts to open the valve 104. The rest periods include time periods immediately prior to opening the valve 104. By adjusting the valve lash 106 during the rest periods, the hydraulic actuator 102 essentially adjusts the valve lash 106 in response to one or more of the actual physical parameters of the valve 104 during engine operation rather than an estimate and/or allowance of the physical parameters. The physical parameters include thermal expansion, wear, manufacturing tolerances, and the like.

Figure 2:
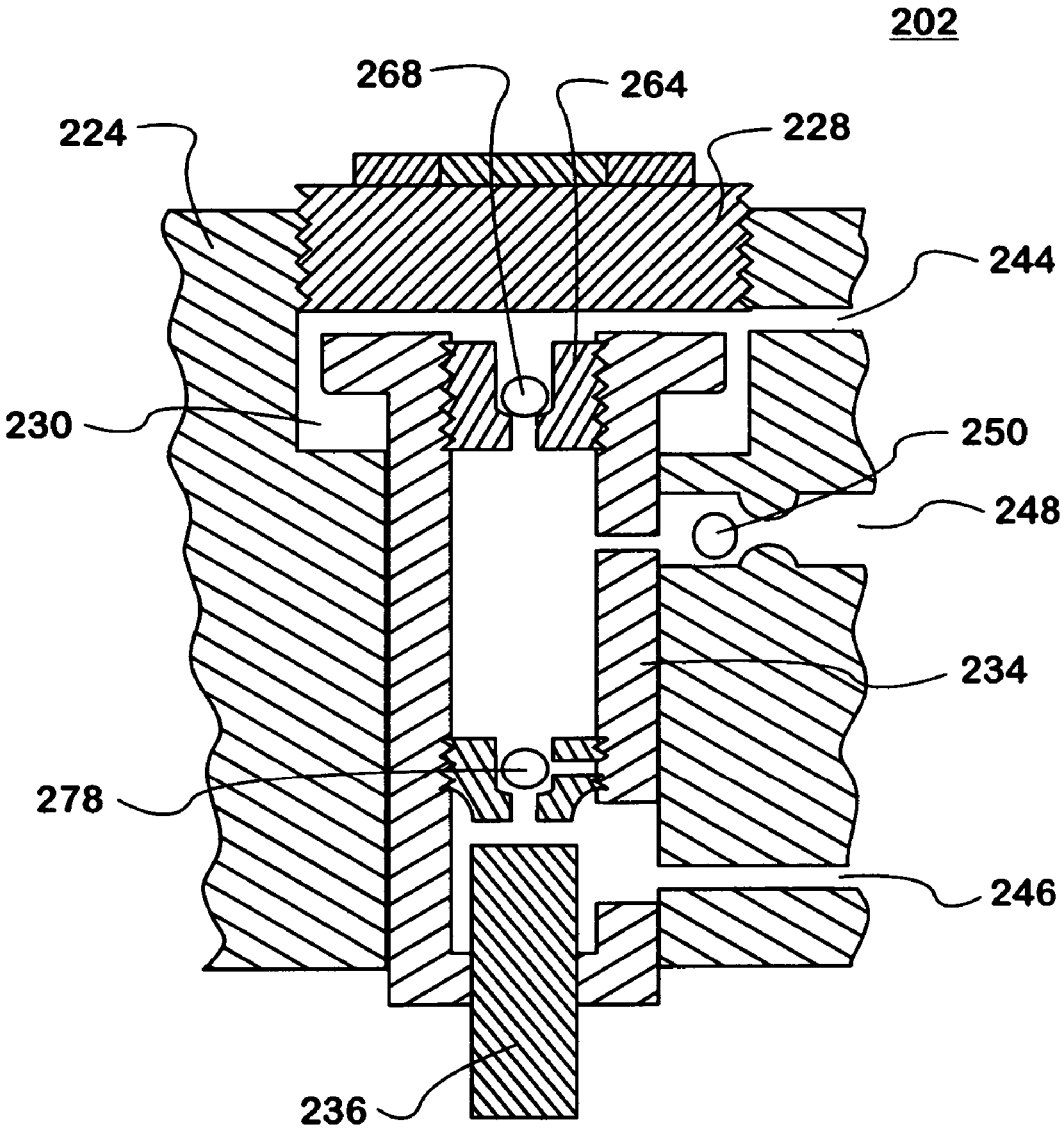
FIG. 2 is a close-up, cross-section view of a hydraulic actuator for a hydraulic valve actuation system.
Figure 3:
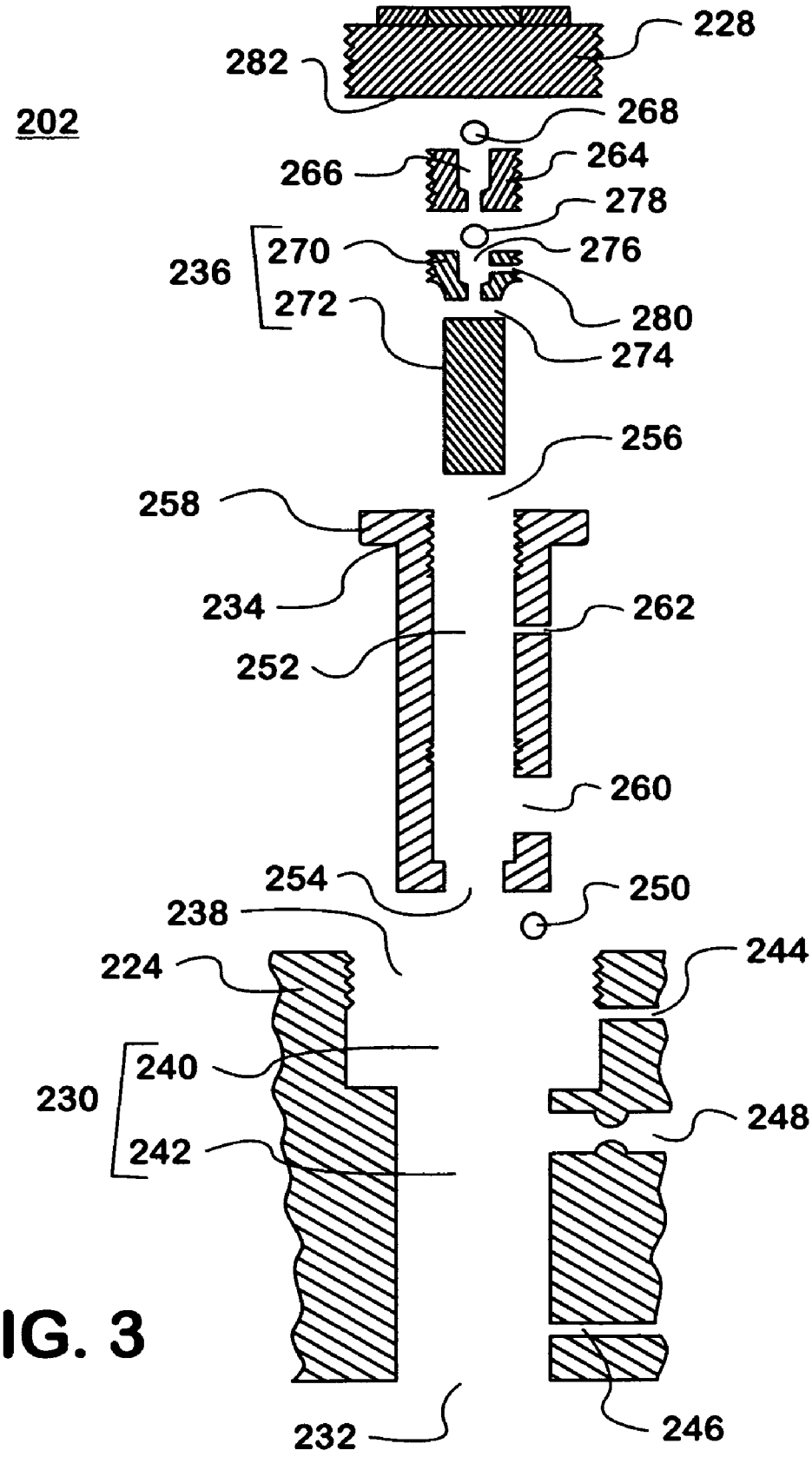
FIG. 3 is an expanded, cross-section view of the hydraulic actuator in FIG. 2.

FIG. 2 is a close-up, cross-section view of a hydraulic actuator 202 for a hydraulic valve actuation system. FIG. 3 is an expanded, cross-section view of the hydraulic actuator 202 in FIG. 2. The hydraulic actuator 202 has a cap 228, a boost pin 234, and a drive pin 236 disposed in an actuation chamber 230 formed by a casing 224. The hydraulic actuator 202 may have other configurations.

The casing 224 defines an actuation opening 232 at one end of the actuation chamber 230 and a cap opening 238 at the other end. The actuation chamber 230 has a boost chamber 240 near the cap opening 238 and a drive chamber 242 near the actuation opening 232. The casing 224 forms a boost passage 244 that connects with the boost chamber 240. The casing 224 forms a drive passage 246 that connects with the drive chamber 242. The casing 224 forms a lash passage 248 that connects with the drive chamber 242. The casing 224 defines a lash check valve or other flow control mechanism in the lash passage 248. The lash check valve may have a lash ball 250 disposed in the lash passage 248 to form a ball-on-seat or one-way pressure release valve. The lash check valve may have a spring, retainer, or like device to bias or hold the lash ball 250 in the lash passage 248.

The boost pin 234 forms a lash chamber 252 that defines a drive opening 254 at one end and a boost opening 256 at the other end. A flange section 258 extends radially from the boost pin 234 near the boost opening 256. The boost pin 234 forms a drive portal 260 that connects with the lash chamber 252 near the drive opening 254. The boost pin forms a lash portal 262 that connects with the lash chamber 252 in between the drive portal 260 and the boost opening 256. The boost pin 234 has a plug 264 disposed in the boost opening 256. The plug 264 forms a boost channel 266 that connects with the lash chamber 252. The plug 264 defines a boost check valve or other flow control mechanism in the boost channel 266. The boost check valve may have a boost ball 268 disposed in the boost channel 266 to form a ball-on-seat or one-way pressure release valve. The boost check valve may have a spring retainer, or like device to bias or hold the boost ball 268 in the boost channel 266.

The drive pin 236 has a pin head 270 connected to a pin shaft 272. The drive pin 236 forms a shaft channel 274 and a head channel 276. The shaft channel 274 extends radially through the pin shaft 272 and connects with the head channel 276, which extends axially through the pin head 270. The pin head 270 defines a pin check valve or other flow control mechanism in the head channel 276. The pin check valve may have a pin ball 278 disposed in the head channel 276 to form a ball-on-seat or one-way pressure release valve. The pin check valve may have a spring retainer, or like device to bias or hold the pin ball 278 in the head channel 276. The pin head 270 forms a side portal 280 that connects with the head channel 276.

The cap 228 has an interior surface 282 that faces the boost pin 234 when the hydraulic actuator 202 is assembled. The interior surface 282 may be substantially flat and engage essentially the entire circumference of the flange section 258 when the boost pin 234 is pushed against the cap 228. The interior surface 282 may have a concave configuration that forms a dome-shaped compartment with the boost pin 234 when the flange section 258 engages the cap 228. The flange section 258 may be essentially flat and enclose the compartment. The flange section 258 may have a flat portion and a tapered portion. The flat portion partially encloses the compartment. The tapered portion forms an opening between the compartment and the boost chamber 240. The interior surface may have a two-step configuration. One step engages the flange section 258 when the boost pin 234 is pushed against the cap 228. The other step forms a step-shaped compartment with the boost pin 234. The step-shaped compartment may connect with the boost chamber 240. The interior surface 282 and flange section 258 may have other configurations.

When assembled, the drive pin 236 is disposed in the lash chamber 252 formed by the boost pin 234. The pin shaft 272 extends through the drive opening 254. The pin shaft 272 is operable to slide or move in the drive opening 254. The pin head 270 may have a larger diameter than the drive opening 254 to prevent the drive pin 236 from falling out of the boost pin 234. The pin ball 278 is disposed in the head channel 276. The plug 264 is disposed in the boost opening 256. The lash ball 250 is disposed in the lash passage 248. The boost pin 234 is disposed in the actuation chamber 230 with the flange section 258 disposed in the boost chamber 240. The boost pin 234 is operable to slide or move within the drive chamber 242. The pin shaft 272 extends through the actuator opening 232 to connect and define the valve lash with a valve stem as previously discussed. The cap 228 is disposed in the cap opening 238 with the interior surface facing the boost pin 234.

In operation, the hydraulic actuator 202 hydraulically adjusts the valve lash during rest periods as previously discussed. Low pressure oil is supplied to the hydraulic actuator. The low pressure oil flows through the lash passage 248, through the lash portal 262, and into the lash chamber 252. The oil moves the boost pin 234 adjacent to the cap 228 and the drive pin 236 adjacent to the valve stem, thus adjusting the valve lash. The valve lash may be adjusted to essentially zero or another selected clearance. If the low pressure oil exceeds a predetermined pressure, the boost check valve opens to release oil from the lash chamber 252. The oil flows through the boost channel 266, through the boost chamber 240, and out through the boost passage 244. If the drive pin 236 moves past a predetermined position in the lash chamber 252, the side portal 280 aligns with the drive portal 260 to release oil from the lash chamber 252. The oil flows from the lash chamber 252, through the side portal 280 and the drive portal 260, and out through the drive passage 246. The boost passage 244 and the drive passage 246 are vented during the rest periods.

To actuate a valve, high pressure oil is supplied to the hydraulic actuator 202. The high pressure oil flows through the boost passage 244 into the boost chamber 240. The high pressure oil closes the boost check valve in the plug 264 and moves the boost pin 234 away from the cap 228. The oil between the flange section 258 and the casing 224 may dampen any impact of the boost pin 234 against the casing 224. The high pressure oil also flows through the drive passage 246 and the drive portal 260, through the shaft channel 274 and the head channel 276, and into the lash chamber 252. The high pressure oil closes the lash check valve, thus keeping the high pressure oil separate from the low pressure oil. The high pressure oil moves the pin head 270 toward the drive opening 254. The drive pin 236 applies an actuating force to a valve stem to move a valve head into an open position as previously discussed. The boost passage 244 and the drive passage 246 then vent high pressure oil from the boost chamber 240 and the lash chamber 252, respectively, to release the actuating force against the valve stem. The valve stem applies the biasing force of the biasing device to the drive pin 236. The biasing force moves the boost pin 234 and the drive pin 236 toward the cap 228, thus moving the valve into a closed position. The valve lash may be adjusted again as previously discussed.

Figure 4:
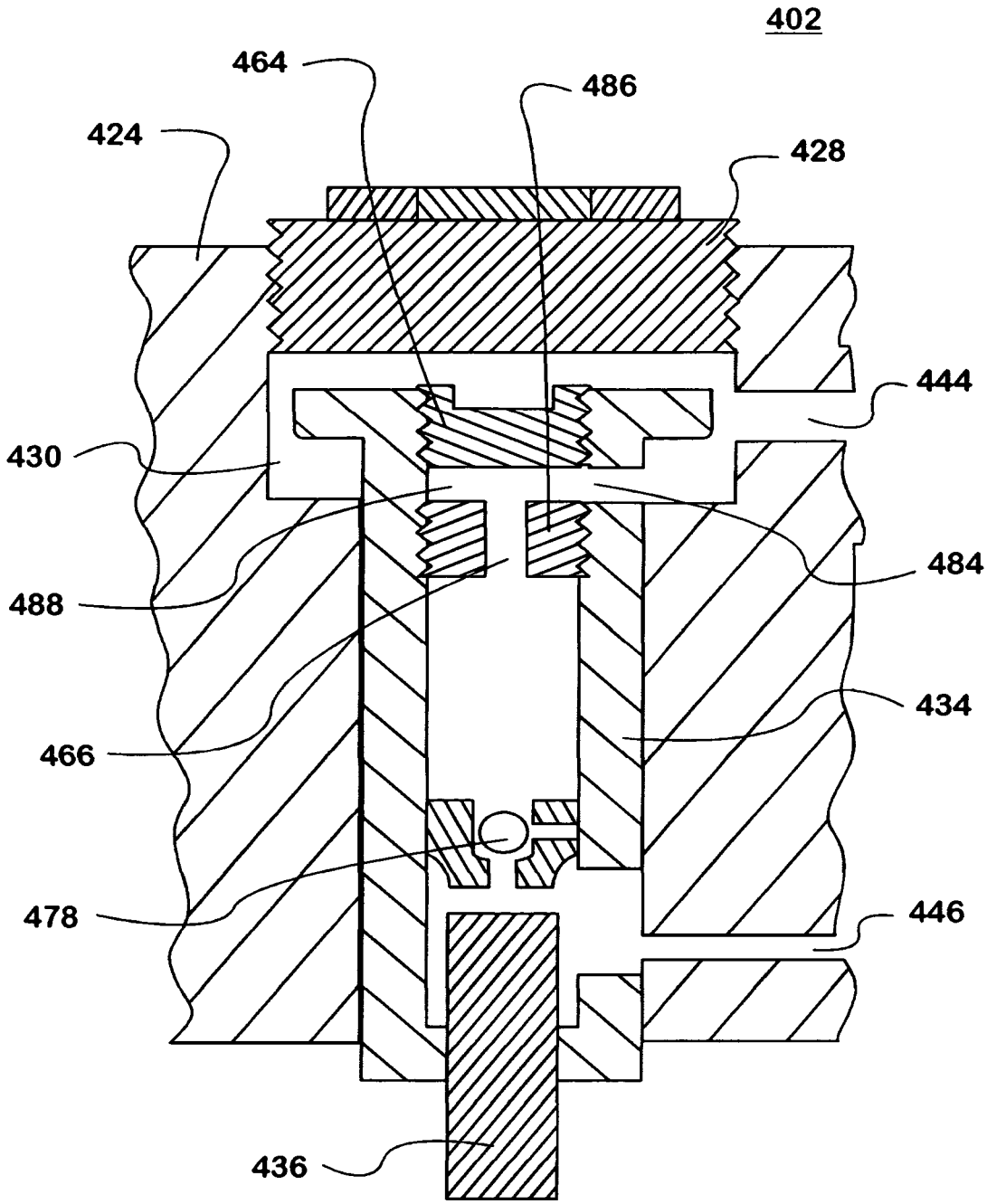
FIG. 4 is a close-up, cross-section view of another hydraulic actuator for a hydraulic valve actuation system.
Figure 5:
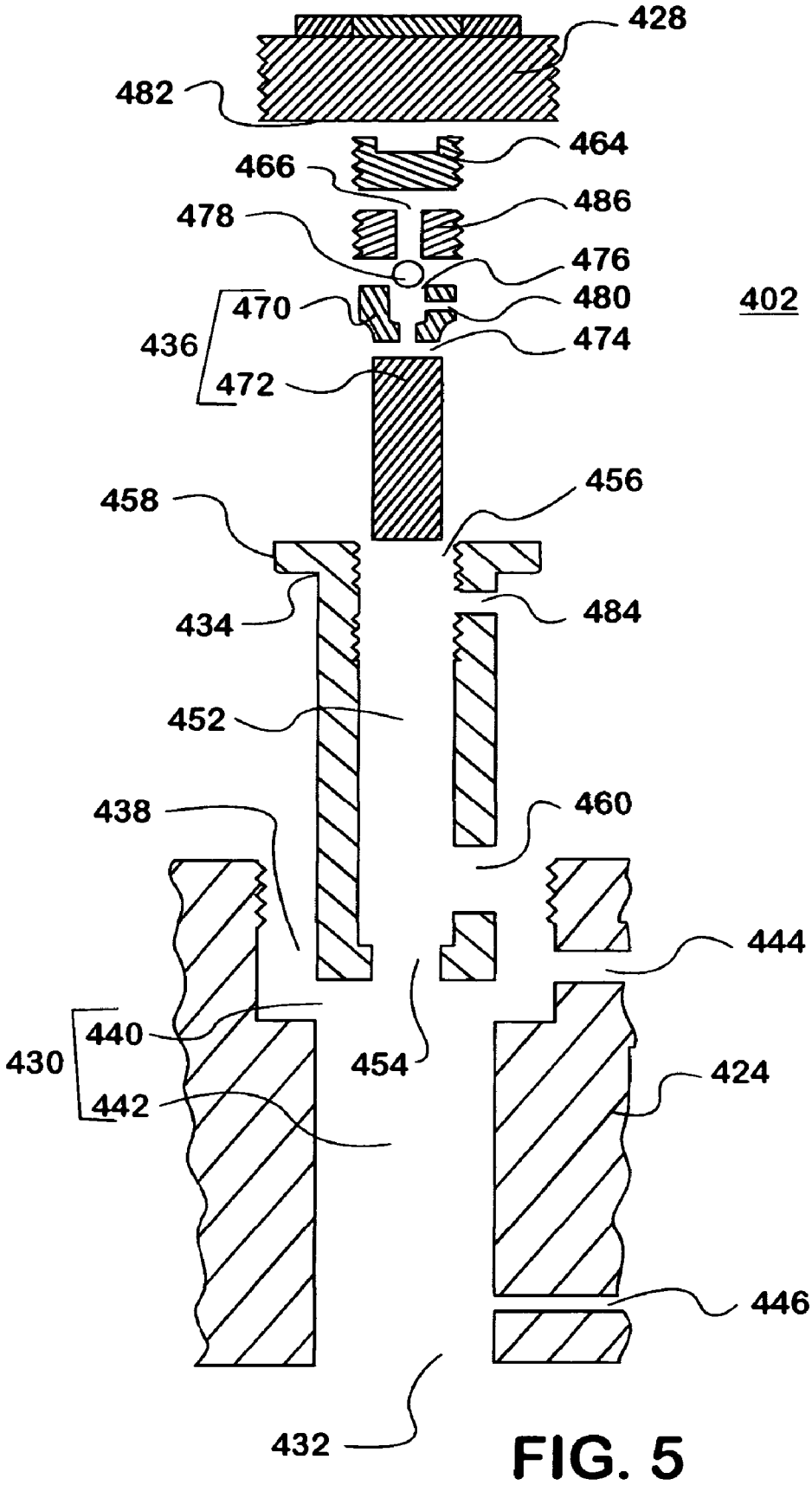
FIG. 5 is an expanded, cross-section view of the hydraulic actuator in FIG. 4.

FIG. 4 is a close-up, cross-section view of another hydraulic actuator 402 for a hydraulic valve actuation system. FIG. 5 is an expanded, cross-section view of the hydraulic actuator 402 in FIG. 4. The hydraulic actuator 402 has a cap 428, a boost pin 434, and a drive pin 436 disposed in an actuation chamber 430 formed by a casing 424. The hydraulic actuator 402 may have other configurations.

The casing 424 defines an actuation opening 432 at one end of the actuation chamber 430 and a cap opening 438 at the other end. The actuation chamber 430 has a boost chamber 440 near the cap opening 438 and a drive chamber 442 near the actuation opening 432. The casing 424 forms a boost passage 444 that connects with the boost chamber 440. The casing 424 forms a drive passage 446 that connects with the drive chamber 442.

The boost pin 434 forms a lash chamber 452 that defines a drive opening 454 at one end and a boost opening 456 at the other end. A flange section 458 extends radially from the boost pin 434 near the boost opening 456. The boost pin 434 forms a drive portal 460 that connects with the lash chamber 452 near the drive opening 454. The boost pin 434 forms a boost portal 484 that connects with the lash chamber 452 near the boost opening 456. The boost pin 434 has an intermediate plug 486 disposed in the lash chamber 452 between the drive portal 460 and the boost portal 484. The boost pin 434 has an end plug 464 disposed in the boost opening 456. The end plug 464 and the intermediate plug 486 define a boost conduit 488 that aligns with the boost portal 484. The intermediate plug 486 forms a boost channel 466 that connects the lash chamber 452 with the boost conduit 488. The end plug 464 and the intermediate plug 486 may be single component such as a cross-drilled plug.

The cap 428 and the drive pin 436 are essentially the same as previously discussed. The cap 428 has an interior surface 482 that faces the boost pin 434 when the hydraulic actuator 402 is assembled. The drive pin 436 has a pin head 470 connected to a pin shaft 472. The drive pin 436 forms a shaft channel 474, a head channel 476, and a side portal 480. The pin head 470 defines a pin check valve or other flow control mechanism in the head channel 476. The pin check valve may have a pin ball 478 disposed in the head channel 476 to form a ball-on-seat or one-way pressure release valve. The pin check valve may have a spring retainer, or like device to bias or hold the pin ball 478 in the head channel 476.

When assembled, the drive pin 436 is disposed in the lash chamber 452 formed by the boost pin 434 as previously discussed. The pin ball 478 is disposed in the head channel 476. The intermediate plug 486 is disposed in the lash chamber 452 in between the drive portal 460 and the boost portal 484. The end plug 464 is disposed in the boost opening 456. The boost pin 434 is disposed in the actuation chamber 430 as previously discussed. The pin shaft 472 extends through the actuator opening 432 to connect and define the valve lash with a valve stem. The cap 428 is disposed in the cap opening 438.

In operation, the hydraulic actuator 402 may hydraulically adjust the valve lash during rest periods as previously discussed. When the lash chamber 452 is empty or less than full of oil, high pressure oil may be supplied to the hydraulic actuator during a rest period. The lash chamber 452 may be empty or less than full during cold engine start and other operating conditions. The high pressure oil flows through the drive passage 446 and the drive portal 460, through the shaft channel 474 and the head channel 476, and into the lash chamber 452. The high pressure oil moves the boost pin 434 adjacent to the cap 428 and the drive pin 436 adjacent to the valve stem, thus adjusting the valve lash as previously discussed. As the boost pin 434 moves toward the cap 428, the boost portal 484 moves into the boost chamber thus venting oil from the lash chamber 452 before the hydraulic actuator 402 can open the valve. The oil flows through the boost channel 466, through the boost conduit 488, and out of the boost portal 484 into the boost chamber 440. The oil flows from out of the boost passage 444, which is vented during the rest periods. During valve operation, the filling of the lash chamber 452 during a rest period may not be necessary as the loss of oil from the lash chamber 452 may be minimal due to the low inertia of the hydraulic actuator components and the oil. The lash chamber 452 may be filled during the initial boost phase when a valve is actuated.

To actuate a valve, high pressure oil is supplied to the hydraulic actuator 402. The high pressure oil flows through the boost passage 444 into the boost chamber 440. The high pressure oil flows through the boost portal 484, through the boost conduit 488, and through the boost channel 466 to backfill the lash chamber 452. The oil moves the boost pin 434 away from the cap 428. The oil between the flange section 458 and the casing 424 may dampen any impact of the boost pin 434 against the casing 424. When the boost pin 434 moves away from the cap 428, the casing 424 closes the boost portal 484 as the boost portal 484 moves from the boost chamber 440 into the drive chamber 442. The high pressure oil also flows through the drive passage 446 and the drive portal 460, through the shaft channel 474 and the head channel 476, and into the lash chamber 452. The high pressure oil moves the pin head 470 toward the drive opening 454. The drive pin 436 applies an actuating force to a valve stem to move a valve head into an open position as previously discussed. The boost passage 444 and the drive passage 446 then vent high pressure oil from the boost chamber 440 and the lash chamber 452, respectively, to release the actuating force against the valve stem. The valve stem applies the biasing force of the biasing device to the drive pin 436. The biasing force moves the boost pin 434 and the drive pin 436 toward the cap 428, thus moving the valve into a closed position. The valve lash may be adjusted again as previously discussed.

Figure 6:
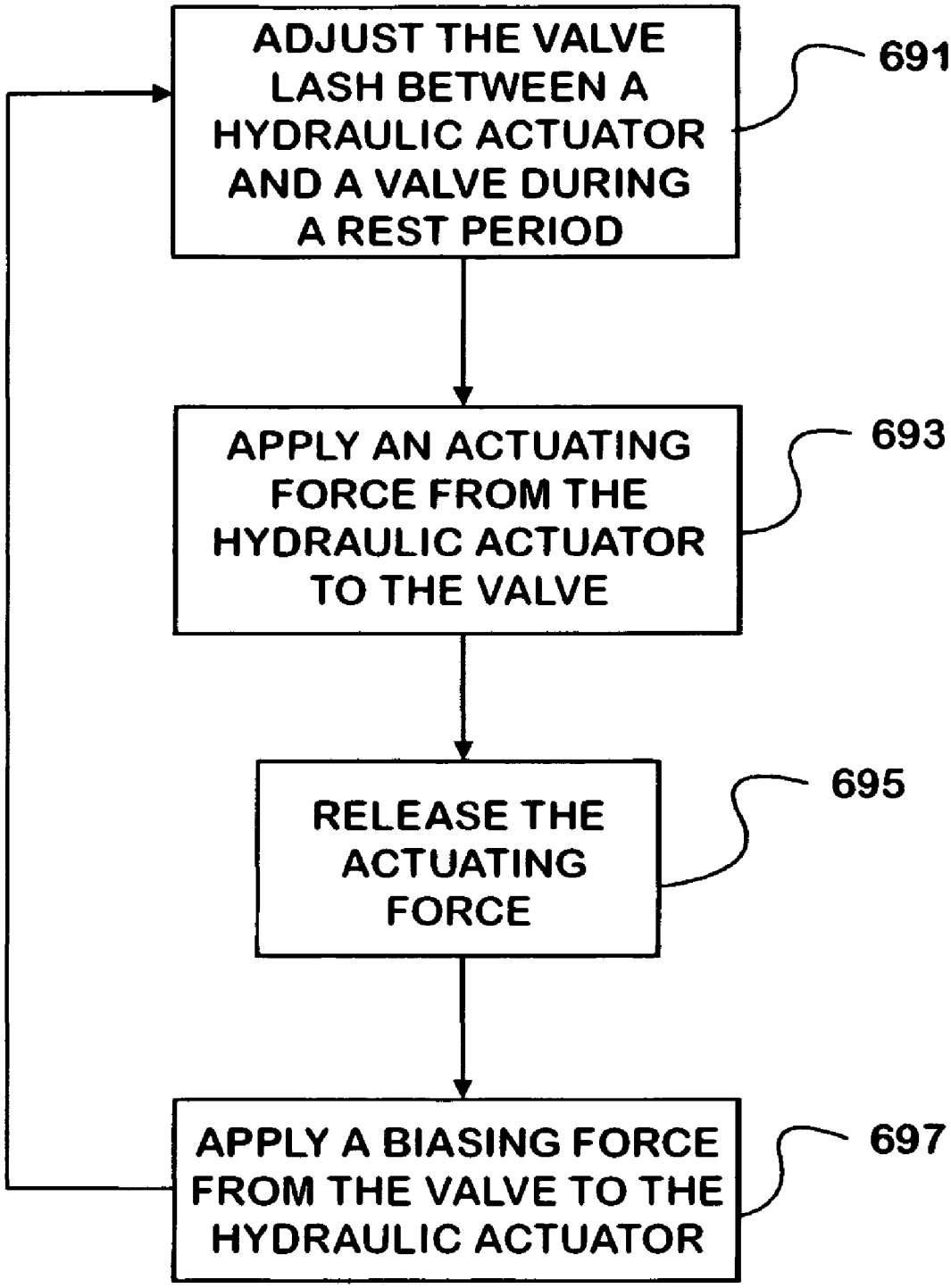
FIG. 6 is a flowchart of a method for actuating a valve in an engine.

FIG. 6 is a flowchart of a method for actuating a valve in an engine. A hydraulic actuator selectively opens and closes the valve during engine operation. The hydraulic actuator adjusts the valve lash between the hydraulic actuator and the valve as previously discussed.

In block 691, the valve lash between the hydraulic actuator and the valve is hydraulically adjusted during a rest period of the hydraulic actuator. Oil is supplied to the hydraulic actuator. The oil may be low pressure oil or high pressure oil as previously discussed. The oil moves a drive pin adjacent to a valve stem in the valve to adjust the valve lash. The rest periods include time periods when the hydraulic actuator is not opening or closing the valve. By adjusting the valve lash during a rest period, the hydraulic actuator essentially adjusts the valve lash in response to one or more of the actual physical parameters of the valve during engine operation rather than an estimate and/or allowance of the physical parameters. The physical parameters include thermal expansion, wear, manufacturing tolerances, and the like. The valve lash 106 may be adjusted to essentially zero or another selected clearance.

In block 693, an actuating force is applied from the hydraulic actuator to the valve. High pressure oil is supplied to the hydraulic actuator. The hydraulic actuator may have a check valve or other flow control mechanism that keeps the high pressure oil separate from low pressure oil used to adjust the valve lash. In response to the high pressure oil, a drive pin in the hydraulic actuator applies an actuating force to a valve stem in the valve as previously discussed. The actuating force moves a valve head in the valve into an open position.

In block 695, the actuating force is released. The hydraulic actuator vents the high pressure oil as previously discussed.

In block 697, a biasing force is applied from the valve to the hydraulic actuator. A biasing device applies a biasing force to the valve stem in the valve. The valve stem applies the biasing force to the drive pin in the hydraulic actuator as previously discussed. The biasing force moves the drive pin into the hydraulic actuator, and thus moves the valve head into a closed position. The valve lash may be adjusted again during the next rest period.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A hydraulic actuator for a valve in an engine, comprising:

a casing forming an actuation chamber with an actuation opening and a cap opening;

a boost pin disposed in the actuation chamber, wherein the boost pin is operable to move within the actuation chamber, wherein the boost pin forms a lash chamber with a drive opening and a boost opening;

a drive pin disposed in the lash chamber, wherein the drive pin is operable to move in the lash chamber and to extend through the drive and actuation openings;

a cap disposed in the cap opening;

wherein the drive pin and boost pin are operable to actuate a valve; and wherein the drive pin and boost pin are operable to adjust a valve lash when oil enters the lash chamber during at least one rest period.

2. The hydraulic actuator of claim 1, further comprising:

a casing forming an actuation chamber with a boost chamber near the cap opening and a drive chamber near the drive opening;

wherein the boost pin is operable to move toward the actuation opening when high pressure oil enters the boost chamber, wherein the boost pin is operable to move toward the cap when the high pressure oil vents from the boost chamber;

wherein the drive pin is operable to move toward the drive opening when high pressure oil enters the lash chamber, wherein the drive pin is operable to move toward the cap when the high pressure oil vents from the lash chamber; and wherein the boost pin is operable to move toward the cap and the drive pin is operable to move toward the drive opening when oil enters the lash chamber during the at least one rest period.

3. The hydraulic actuator of claim 2, further comprising:

a casing forming a boost passage, a drive passage, and a lash passage, wherein the boost passage connects with the boost chamber, wherein the drive passage connects with the drive chamber, wherein the lash passage connects with the drive chamber between the drive passage and the boost chamber, wherein the casing defines a check valve in the lash passage;

a boost pin having a plug disposed in the boost opening, wherein the plug forms a boost channel, wherein the boost pin forms a drive portal and a lash portal;

wherein high pressure oil enters into and vents from the boost chamber through the boost passage;

wherein high pressure oil enters into the lash chamber through the drive passage and drive portal;

wherein high pressure oil vents from the lash chamber through the boost channel, the boost chamber, and the boost passage; and wherein low pressure oil enters into the lash chamber through the lash passage and lash portal during the at least one rest period.

4. The hydraulic actuator of claim 3, further comprising a drive pin forming a shaft channel connected with a head channel, wherein high pressure oil flows through the shaft channel and the head channel into the lash chamber.

5. The hydraulic actuator of claim 2, further comprising:

a casing forming a boost passage and a drive passage, wherein the boost passage connects with the boost chamber, wherein the drive passage connects with the drive chamber;

a boost pin having a plug with a boost channel, wherein the boost pin forms a drive portal and a boost portal;

wherein high pressure oil enters into and vents from the boost chamber through the boost passage;

wherein high pressure oil enters into the lash chamber through the drive passage and drive portal;

wherein high pressure oil vents from the lash chamber through the boost channel, the boost portal, the boost chamber, and boost passage; and wherein high pressure oil vents from the lash chamber before the drive pin and boost pin can actuate the valve during the at least one rest period.

6. The hydraulic actuator of claim 5, further comprising a drive pin forming a shaft channel connected with a head channel, wherein high pressure oil flows through the shaft channel and the head channel into the lash chamber.

7. The hydraulic actuator of claim 5, further comprising:

a boost pin forming a drive portal and a boost portal, wherein the boost pin has an end plug and an intermediate plug, wherein the end plug is disposed in the boost opening, wherein the intermediate plug is disposed in the lash chamber between the drive and boost portals, wherein the intermediate plug defines a boost channel, wherein the end and intermediate plugs define a boost conduit;

wherein high pressure oil enters into and vents from the boost chamber through the boost passage;

wherein high pressure oil enters into the lash chamber through the drive passage and drive portal;

wherein high pressure oil vents from the lash chamber through the boost channel, the boost conduit, the boost portal, the boost chamber, and boost passage; and wherein high pressure oil vents from the lash chamber before the drive pin and boost pin can actuate the valve during the at least one rest period.

8. The hydraulic actuator of claim 1, wherein the valve lash is adjusted to essentially zero.

9. The hydraulic actuator of claim 1, wherein the valve lash is adjusted in response to at least one actual physical parameter of the valve during engine operation.

* * * * *